US006291152B1

(12) United States Patent
Burns et al.

(10) Patent No.: US 6,291,152 B1
(45) Date of Patent: Sep. 18, 2001

(54) PHOTOGRAPHIC ELEMENT HAVING IMPROVED DYE STABILITY, COMPOUND, AND IMAGING PROCESS

(75) Inventors: Paul A. Burns; Robert F. Romanet; Susan M. Fischer, all of Rochester; David G. Lincoln, Webster; Paul P. Spara, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/707,636

(22) Filed: Nov. 7, 2000

(51) Int. Cl.[7] ..... G03C 1/08; G03C 7/26; G03C 7/32

(52) U.S. Cl. ..... 430/558; 430/386; 430/387

(58) Field of Search ..... 430/502, 543, 430/538, 386, 387

(56) References Cited

U.S. PATENT DOCUMENTS

| | | | | |
|---|---|---|---|---|
| 5,254,451 | * | 10/1993 | Kita et al. | 430/558 |
| 5,609,996 | | 3/1997 | Tang et al. . | |
| 5,925,503 | | 7/1999 | Harder et al. . | |
| 5,972,587 | * | 10/1999 | Romanet et al. | 430/558 |
| 5,985,533 | | 11/1999 | Romanet et al. . | |

FOREIGN PATENT DOCUMENTS

| | | | |
|---|---|---|---|
| 5158198 | * | 6/1993 | (JP) . |
| 8146575 | * | 6/1996 | (JP) . |
| 10142757 | * | 5/1998 | (JP) . |
| 10186603 | * | 7/1998 | (JP) . |

* cited by examiner

*Primary Examiner*—Geraldine Letscher
(74) *Attorney, Agent, or Firm*—Arthur E. Kluegel

(57) ABSTRACT

Disclosed is a photographic element comprising a light-sensitive silver halide emulsion layer having associated therewith a bicyclic azole dye-forming coupler, having appended to a ring carbon at a non-coupling position thereof a substituent group represented by the formula:

wherein the arrow represents the point of attachment of the substituent group to a non-coupling position of the coupler;

$R^1$, $R^2$, $R^3$ and $R^4$ are independently selected hydrogen or substituent groups, provided that any two of $R^1$, $R^2$, $R^3$ and $R^4$ may join to form a ring;

$R^a$ and $R^b$ are independently hydrogen or a substituent;

each $R^c$ and $R^d$ is an independently selected hydrogen or an alkyl or aryl group, provided that any two of them may join to form a ring and n is 1 to 10;

$R^e$ is hydrogen or an alkyl or aryl group;

each Y is an independently selected substituent group and m is from 0 to 4; and

Z is a substituent selected from the group consisting of $—C(O)R^5$, $—S(O)_2R^5$, $—SOR^5$, $—P(=O)(R^6)_2$ and $—P(=O)(OR^6)_2$ in which $R^5$ is selected from the group consisting of alkyl, aryl, heterocyclic, alkoxy, aryloxy, alkylamino, and arylamino groups and each $R^6$ is independently selected from the group consisting of alkyl and aryl groups; provided that Z can form a ring with any one of $R^c$ and $R^d$. Such an element provides improved image dye stability.

27 Claims, No Drawings

PHOTOGRAPHIC ELEMENT HAVING IMPROVED DYE STABILITY, COMPOUND, AND IMAGING PROCESS

CROSS REFERENCE TO RELATED APPLICATION

Co-filed herewith is an application under employing a bicyclic azole coupler in a silver halide photographic element for improved color rendition.

FIELD OF THE INVENTION

This invention relates to a silver halide photographic element and process for its use in which the element contains a bicyclic azole dye-forming coupler having a substituent group that provides a color photographic image having improved image dye stability.

BACKGROUND OF THE INVENTION

Conventional color photography depends on the formation of dyes and uses subtractive primaries to form the desired colors. One of the problems encountered with the dyes that form the images is their tendency to degrade when exposed to light. This is of particular importance with respect to photographic elements intended for direct viewing. Since the advent of color photography there have been ongoing efforts to improve the dye stability. Efforts have been ongoing to provide stabilized dyes which exhibit improved light stability. In particular, proposals have been made for new couplers that provide desirable dye properties but the resulting dyes often do not exhibit the satisfactory dye stability.

U.S. Pat. Nos. 5,925,503; 5,972,574; and 5,972,587 disclose 1H-pyrazolo[5,1-c]-1,2,4-triazole magenta dye-forming couplers that provide a desirable hue for silver halide photographic elements. Generic formulas for these prior art couplers are as follows:

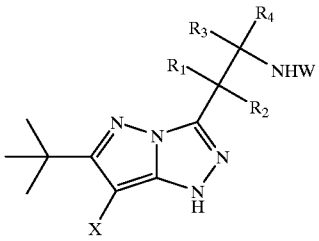

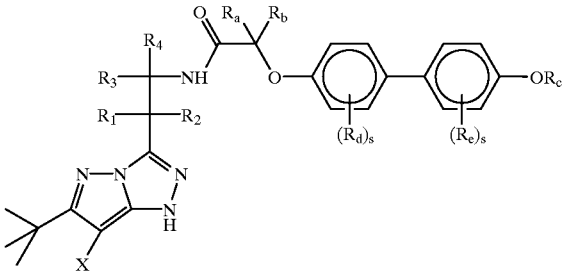

and

-continued

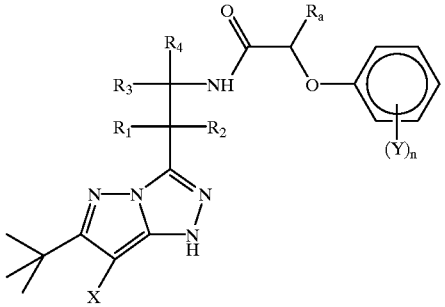

The first and third formulae may comprise a carbonamidoethyl link to the pyrazolotriazole coupler. It has been found that the stability of the resulting dye to light exposure using these generic types of couplers is unsatisfactory.

It is a problem to be solved to provide a silver halide photographic element containing a bicyclic azole dye-forming coupler that forms an image dye that exhibits improved image dye stability.

SUMMARY OF THE INVENTION

The invention provides a photographic clement comprising a light-sensitive silver halide emulsion layer having associated therewith a bicyclic azole dye-forming coupler, having appended to a ring carbon at a non-coupling position thereof a substituent group represented by the formula:

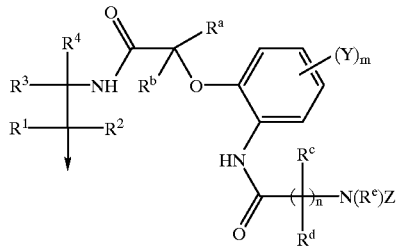

wherein the arrow represents the point of attachment of the substituent group to a non-coupling position of the coupler;

$R^1$, $R^2$, $R^3$ and $R^4$ are independently selected hydrogen or substituent groups, provided that any two of $R^1$, $R^2$, $R^3$ and $R^4$ may join to form a ring;

$R^a$ and $R^b$ are independently hydrogen or a substituent;

each $R^c$ and $R^d$ is an independently selected hydrogen or an alkyl or aryl group, provided that any two of them may join to form a ring and n is 1 to 10;

$R^e$ is hydrogen or an alkyl or aryl group;

each Y is an independently selected substituent group and m is from 0 to 4; and

Z is a substituent selected from the group consisting of $—C(O)R^5$, $—S(O)_2R^5$, $—SOR^5$, $—P(=O)(R^6)_2$ and $—P(=O)(OR^6)_2$ in which $R^5$ is selected from the group consisting of alkyl, aryl, heterocyclic, alkoxy, aryloxy, alkylamino, and arylamino groups and each $R^6$ is independently selected from the group consisting of alkyl and aryl groups; provided that Z can form a ring with any one of $R^c$ and $R^d$.

The invention also provides a process for forming an image in the element of the invention as well as a new coupler compound.

The element exhibits improved image dye stability.

DETAILED DESCRIPTION OF THE INVENTION

A variety of dye-forming coupler types have been used in photographic materials. Among the known dye-forming couplers are bicyclic azoles that contain an azole ring having a second azole ring fused thereto such as pyrazolotriazoles, pyrazolobenzimidazoles, and imidazopyrazoles. These couplers contain bridgehead nitrogen 5,5 fused ring systems and include such couplers as pyrrolo[1,2-b]pyrazoles, pyrazolo[5,1-c][1,2,4]triazoles, pyrazolo[1,5-b][1,2,4]triazoles, imidazo[1,2-b]pyrazoles, imidazo[1,5-b]pyrazoles, imidazo[1,2-a]imidazoles, imidazo[1,2-b][1,2,4]triazoles, imidazo[2,1-c][1,2,4]triazoles, imidazo[5,1-c][1,2,4]triazoles and [1,2,4]triazolo[3,4-c][1,2,4]triazole. These couplers also contain bridgehead nitrogen 5,5,6 fused ring systems and include compounds such as pyrazolo[3,2-b]benzimidazoles. These couplers may form magenta or cyan dyes, depending on the ring structure and substituents. Preferred couplers are pyrazolotriazoles represented by the Formula M:

M

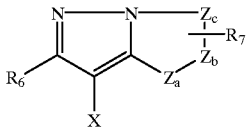

wherein:

$R_6$ is hydrogen, a substituent group or a ballast group;

$R_7$ is a ballast group or a fused benzene ring; and

X is hydrogen or a coupling-off-group, provided that X, $R_6$ and $R_7$ contain a number of carbons sufficient to immobilize the coupler in the emulsion layer; and $Z_a$, $Z_b$, and $Z_c$ are independently a substituted or unsubstituted methine group, =N—,

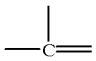

or —NH—, provided that one of either the $Z_a$–$Z_b$ bond or the $Z_b$–$Z_c$ bond is a double bond and the other is a single bond, and when the $Z_b$–$Z_c$ bond is a carbon-carbon double bond, it can be part of an aromatic ring and at least one of $Z_a$, $Z_b$, and $Z_c$ represents a methine group connected to $R_7$. These couplers generally form magenta dyes when $R_6$ and $R_7$ are electron donating groups, and cyan dyes when $R_6$ and $R_7$ are electron withdrawing groups.

In one embodiment, the invention provides a photographic element comprising a light-sensitive silver halide emulsion layer having associated therewith a dye-forming coupler represented by the formula I:

I

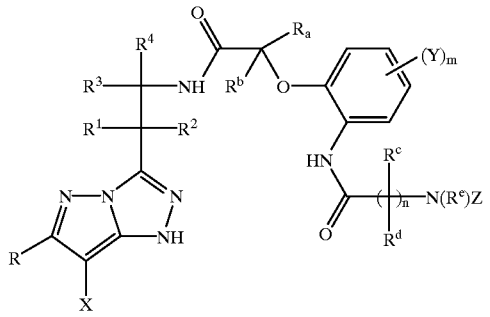

wherein

X is hydrogen or a coupling-off group;

R is a fully substituted carbon atom;

$R^1$, $R^2$, $R^3$ and $R^4$ are independently selected hydrogen or substituent groups, provided that any two of $R^1$, $R^2$, $R^3$ and $R^4$ may join to for a ring;

$R^a$ and $R^b$ are independently hydrogen or a substituent;

each $R^c$ and $R^d$ is an independently selected hydrogen or an alkyl or aryl group, provided that any two of them may join to form a ring and n is 1 to 10;

$R^e$ is hydrogen or an alkyl or aryl group;

each Y is an independently selected substituent group and m is from 0 to 4; and

Z is a substituent selected from the group consisting of —C(O)$R^5$, —S(O)$_2R^5$, —SO$R^5$, —P(=O)($R^6$)$_2$ and —P(=O)(O$R^6$)$_2$ in which $R^5$ is selected from the group consisting of alkyl, aryl, heterocyclic, alkoxy, aryloxy, alkylamino, and arylamino groups and each $R^6$ is independently selected from the group consisting of alkyl and aryl groups; provided that Z can form a ring with any one of $R^c$ and $R^d$.

In formula I, X is hydrogen or a coupling-off group. Suitable coupling-off groups are more fully described hereinafter. They generally comprise a halogen or other group linked to the rest of the molecule by a heteroatom such an oxygen, sulfur, or nitrogen.

R is a fully substituted carbon atom. Typical examples are t-butyl, methylcyclopropyl, t-pentyl, methylcyclohexyl, and adamantyl.

$R^1$, $R^2$, $R^3$ and $R^4$ are independently selected hydrogen or substituent groups, provided that any two of $R^1$, $R^2$, $R^3$ and $R^4$ may join to form a ring. Suitably, $R^1$, $R^2$, and $R^3$ are substituents such as alkyl groups while $R^4$ is hydrogen, or a substituent such as an alkyl group.

Each Y is a substituent, and m is from 1 to 4.

In formula (I), the value of "n" may vary from 1 to 10, preferably 1 to 5 and more preferably 1 to 3. $R^e$ is typically a hydrogen atom although alkyl groups such as C1–C4 alkyl including methyl may be employed. Similarly, aryl groups such as phenyl may be employed.

The $R^a$ and $R^b$ substituents may be the same or different. Suitably they are hydrogen or alkyl groups. Hydrogen substituents are conveniently employed from a synthesis standpoint but better light fade resistance occurs when one of these is a substituent such as an alkyl group.

The $R^c$ and $R^d$ substituents may be the same or different hydrogen, alkyl or aryl groups and two of those substituents may join to form a ring such as a ring based on morpholine. Examples for $R^c$ and $R^d$ are H, C1–C4 alkyl such as methyl, ethyl, propyl and butyl, as well as a ring such as one based on cyclohexane.

Z is conveniently an acyl or sulfonyl group containing one of the above groups listed for $R^5$. Typical for $R^5$ are alkyl groups of 1 to 16 carbon atoms, an aryl group such as a phenyl group, and may include a heterogroup such as a morpholino derivative.

The photographic element of the invention is most typically a color print element in which the light sensitive layers are provided on a paper or other reflective support but can also be provided on a transparent such as in the form of a transparent back-lit sign. Such elements are suitably developed using the presently employed Kodak RA-4 Process. The element may also be comprised of a transparent film support suitable for projection viewing.

The emulsion is typically sensitized to green or red light, depending on the color of the image dye to be formed.

The following, are examples of couplers of the invention. (Hereafter "Et" represents ethyl, "Me" represents methyl, and "Bu" represents butyl.)

M-1

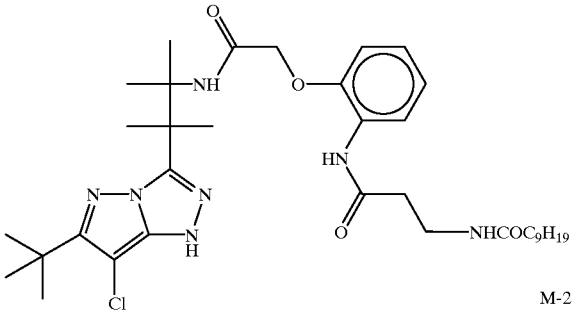

M-2

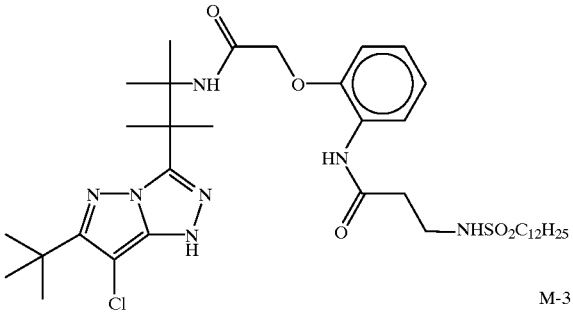

M-3

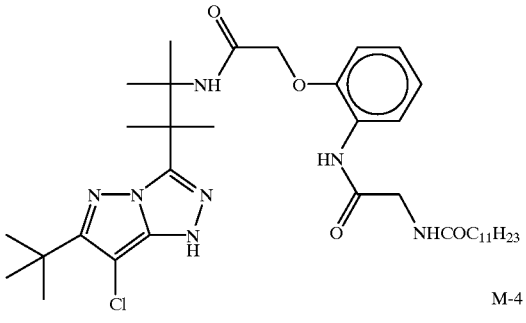

M-4

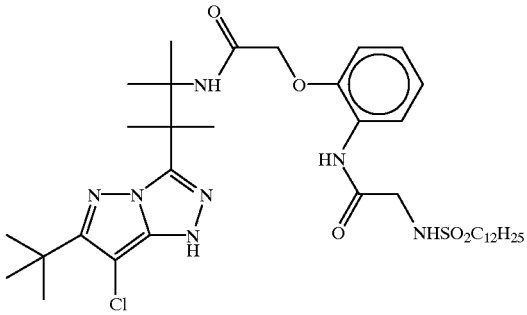

-continued

M-5

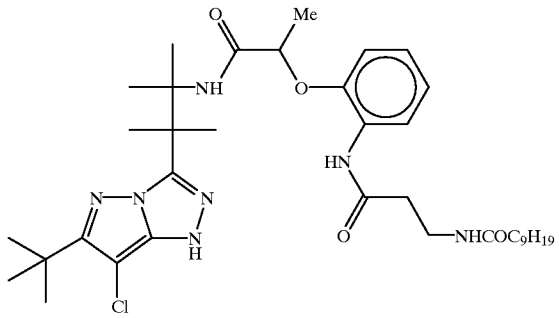

M-6

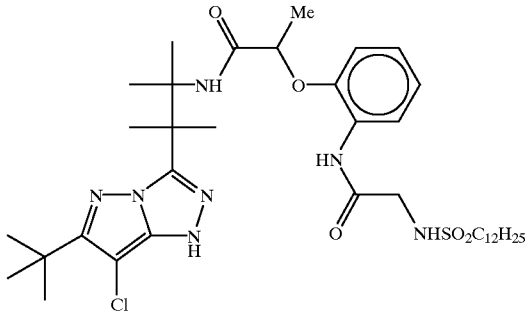

M-7

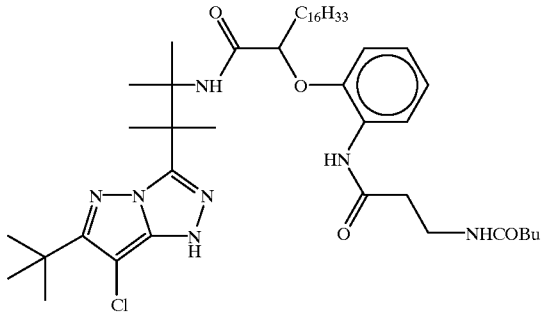

M-8

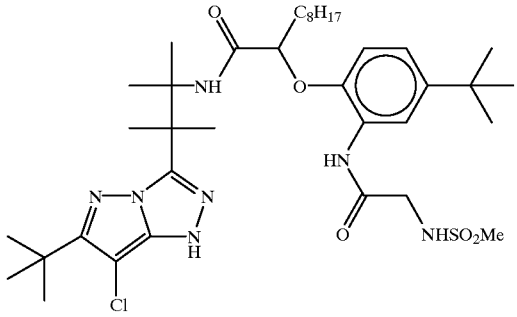

-continued
M-9
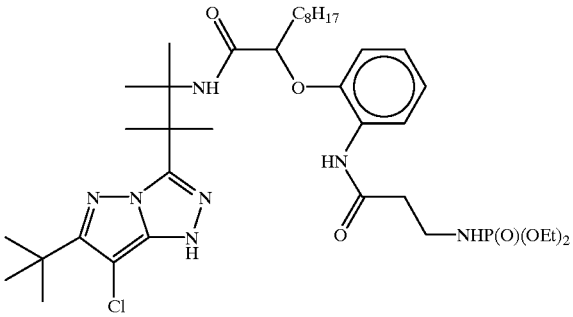
M-10
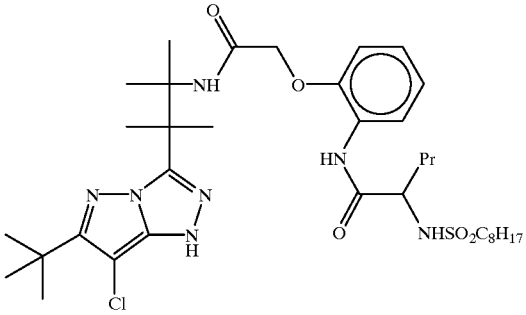
M-11
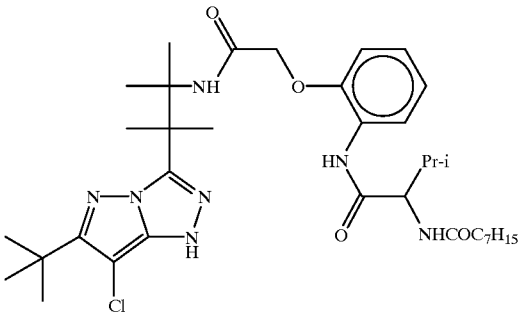
M-12
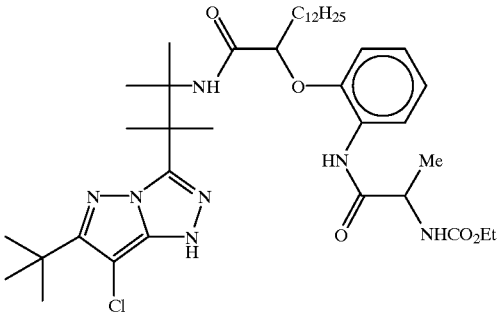
-continued
M-13
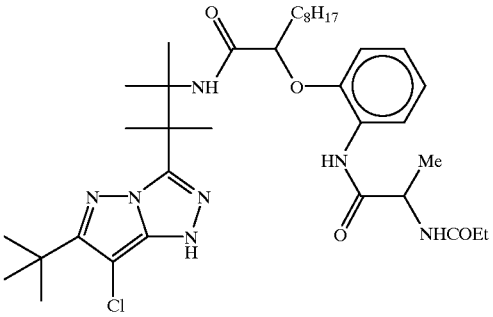
M-14
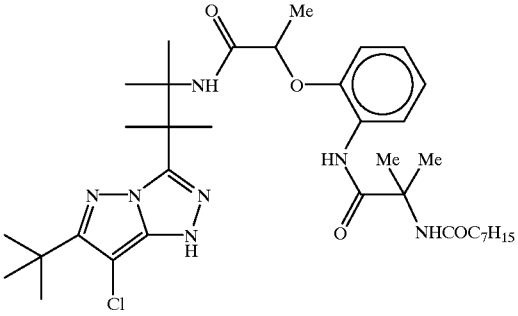
M-15
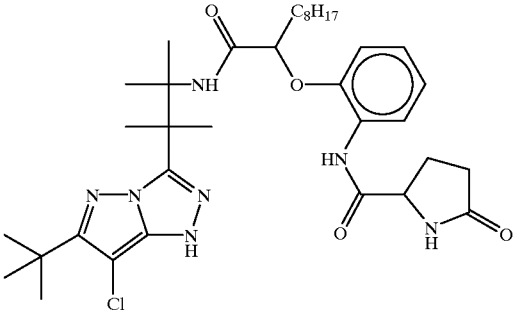
M-16
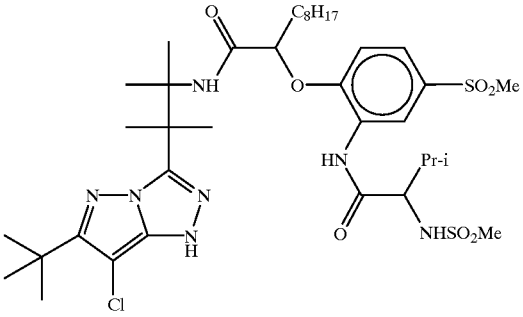

-continued
M-17
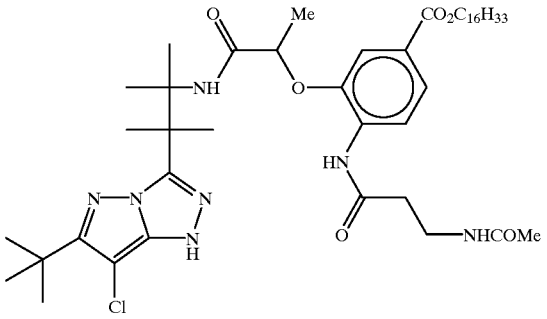
M-18
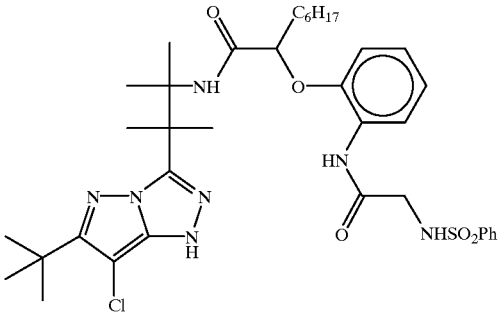
M-19
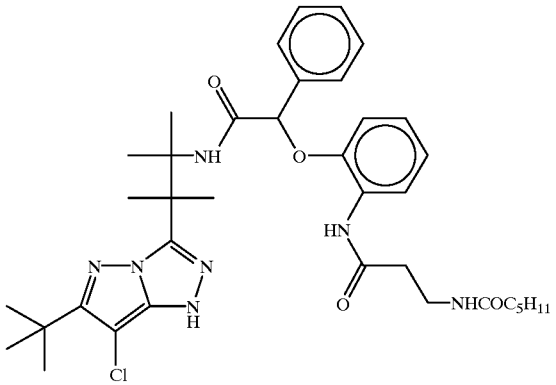
M-20
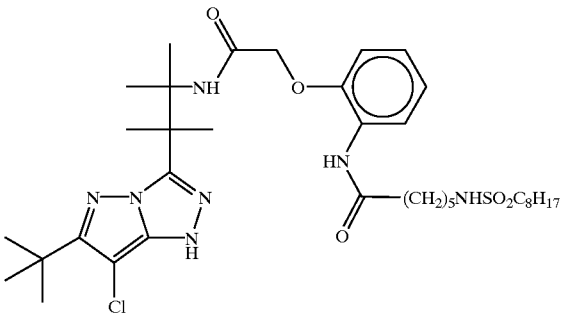
M-21
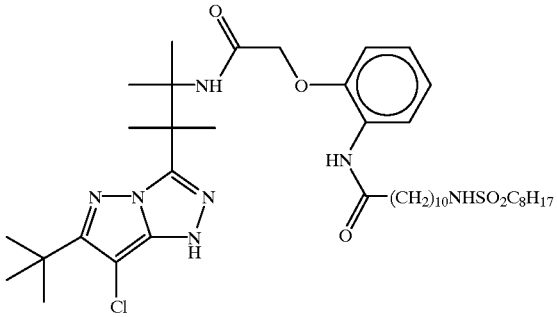
M-22
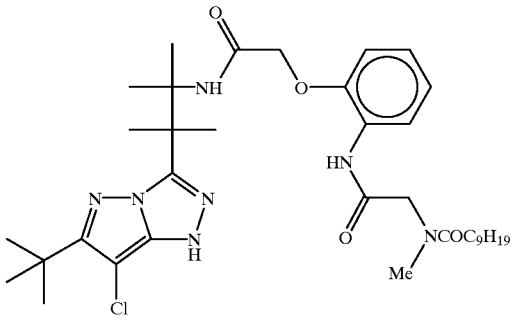
M-23
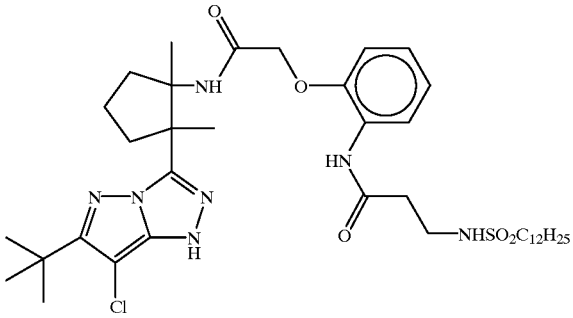
M-24
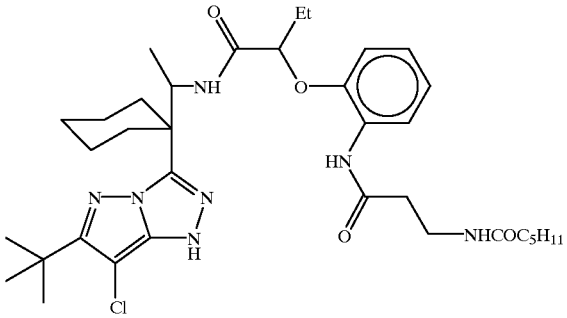

-continued
M-25
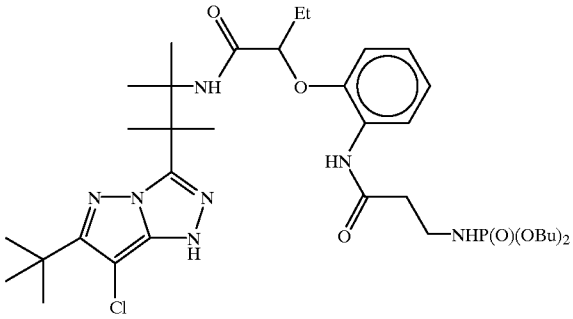
M-26
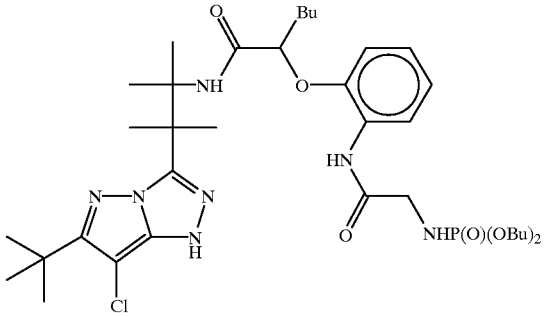
M-27
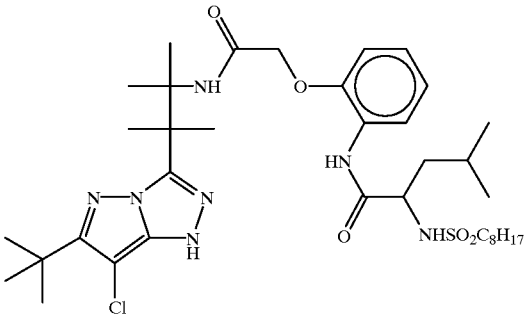
M-28
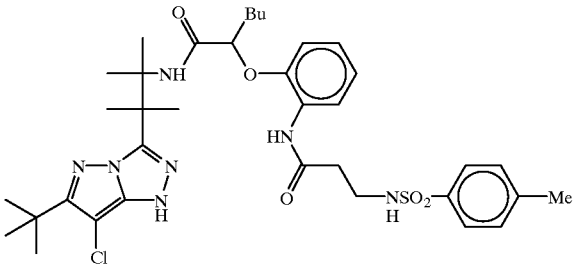
-continued
M-29
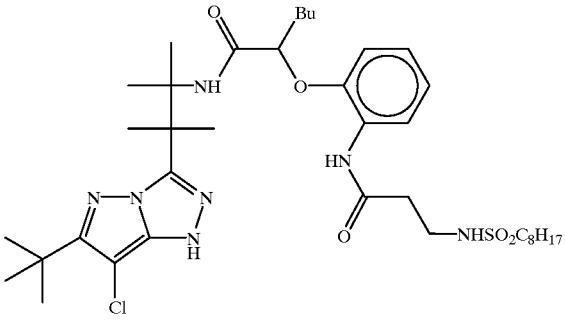
M-30
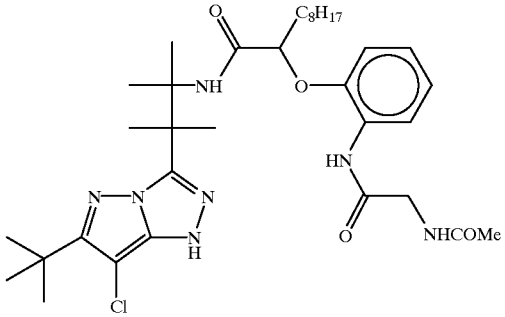
M-31
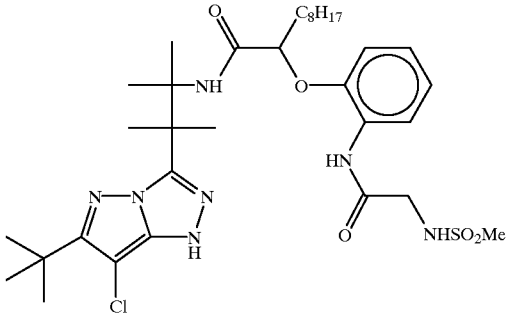
M-32
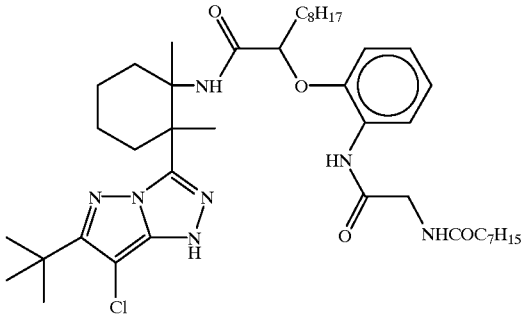

-continued
M-33
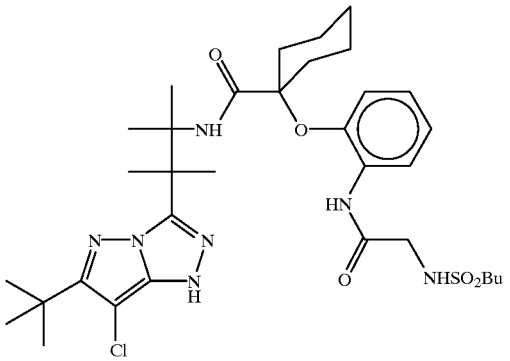
M-34
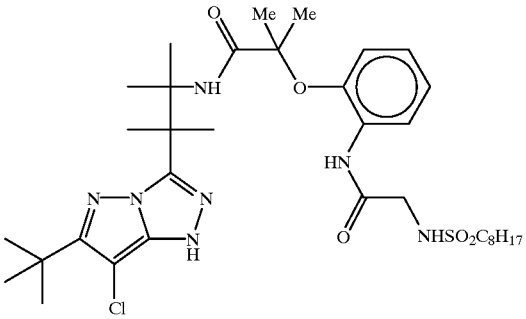
M-35
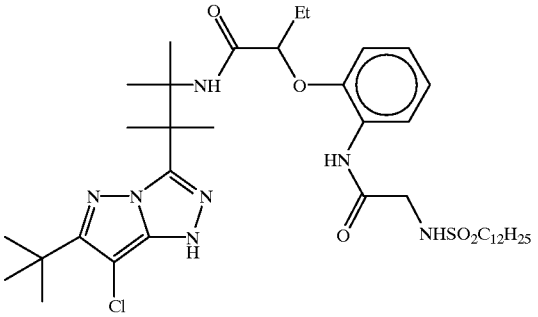
M-36
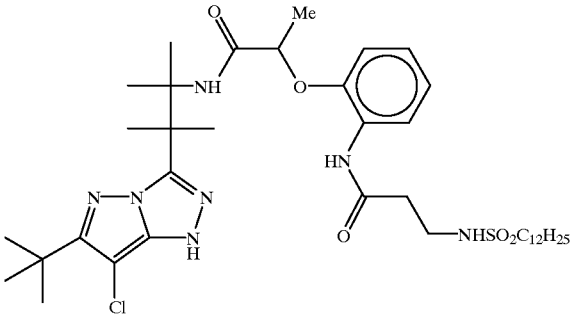
-continued
M-37
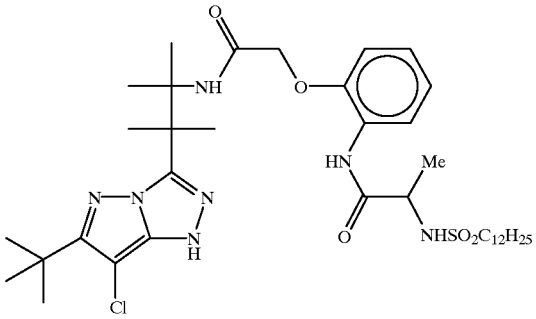
M-38
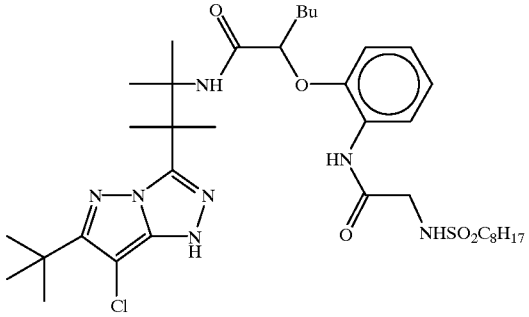
M-39
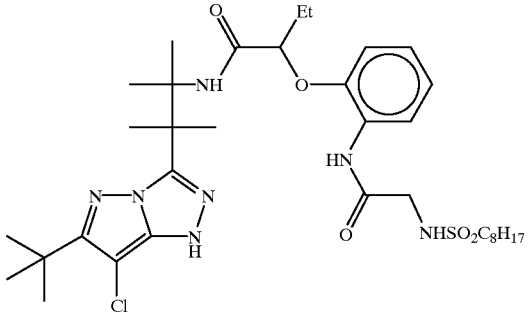
M-40
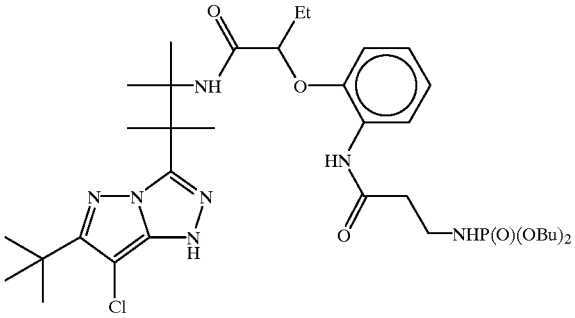

M-41

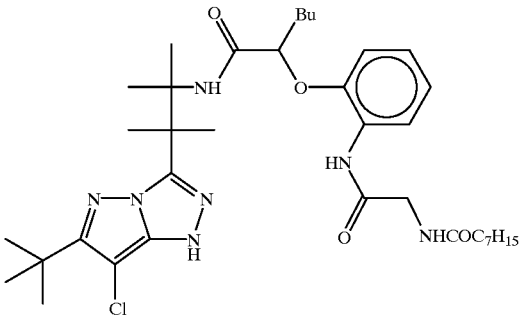

M-42

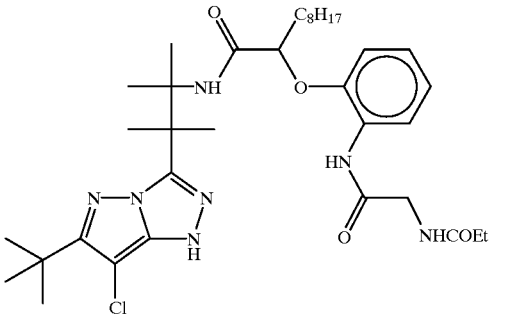

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12*a* North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocycle, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156-175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323;

EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126-156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912, 265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112-126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. Nos. 4,301,235; 4,853, 319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983, 608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR[1] s useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

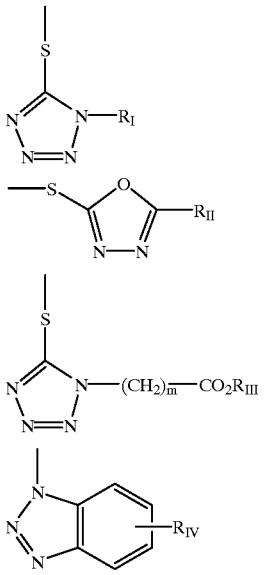

-continued

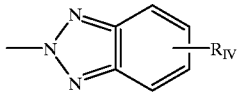

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

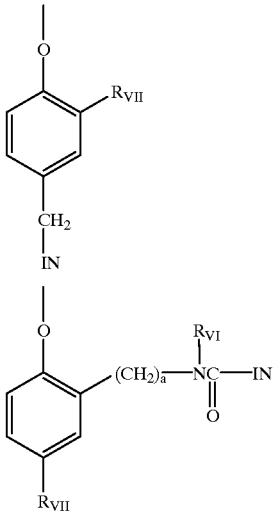

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

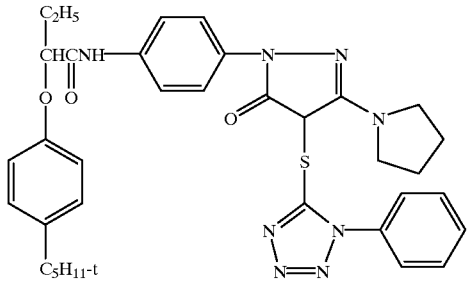

D2

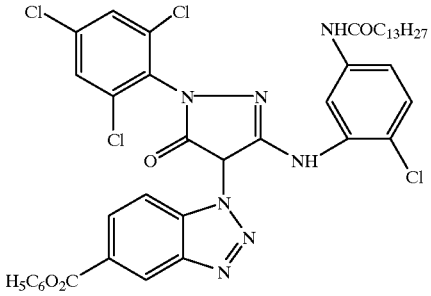

D3

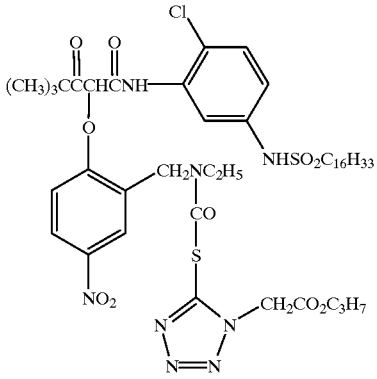

-continued

D4

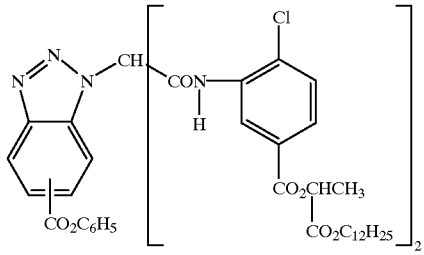

D5

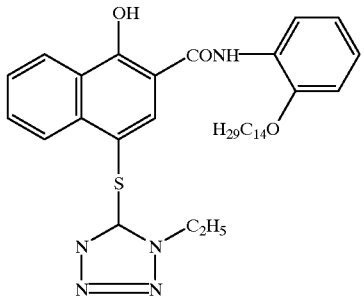

D6

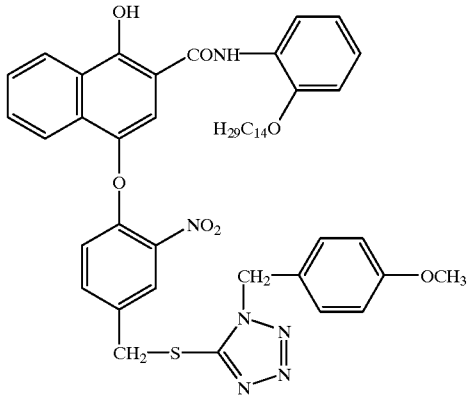

D7

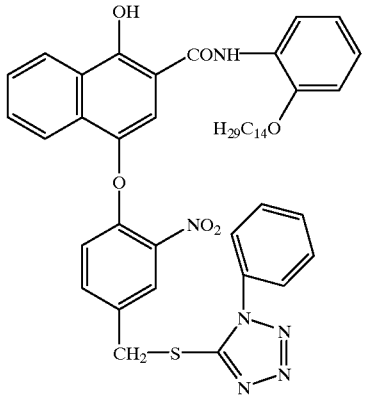

-continued

D8

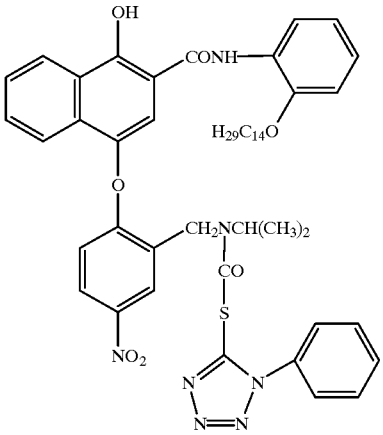

D9

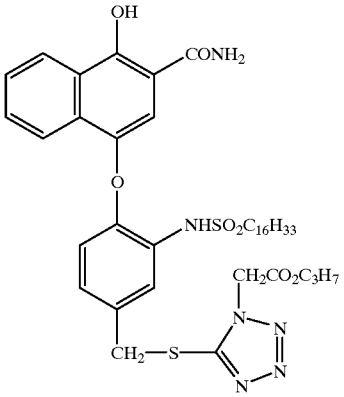

D10

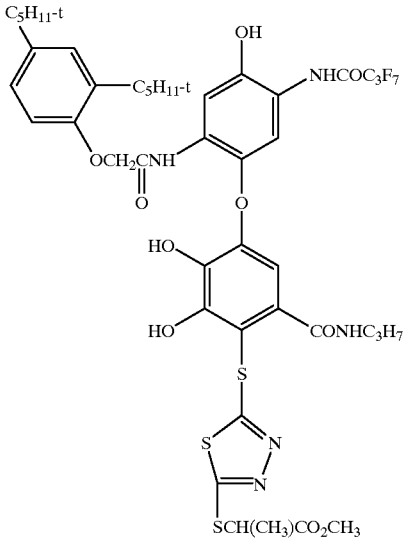

-continued

D11

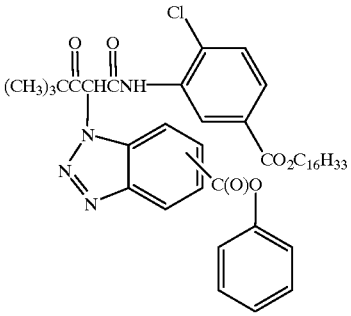

D12

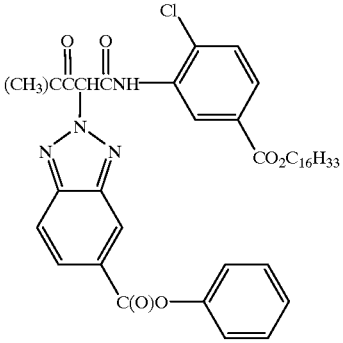

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure,* Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio"is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin--that is, less than 0.2 micrometer and most preferably ultrathin that is, less than 0.07 micrometer). The major faces of the tabular grains can lie in ether {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions arc illustrated by Kofron et al U.S. Pat. Nos. 4,439,520, Wilgus et al 4,434,226, Solberg et al 4,433,048, Maskasky 4,435,501,, 4,463,087 and 4,173,320, Daubendiek et al 4,414,310 and 4,914,014, Sowinski et al 4,656,122, Piggin et al 5,061,616 and 5,061,609, Tsaur et al 5,147,771, '772, '773, 5,171,659 and 5,252,453, Black et al 5,219,720 and 5,334,495, Delton 5,310,644, 5,372,927 and 5,460,934, Wen 5,470,698, Fenton et al 5,476,760, Eshelman et al 5,612,,175 and 5,614,359, and Irving et al 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al 5,250,403, Olm et al 5,503,970, Deaton et al 5,582,965, and Maskasky 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. Nos. 4,399,215, Wey et al 4,414,306, Maskasky 4,400,463, 4,713,323, 5,061,617, 5,178,997, 5,183,732, 5,185,239, 5,399,478 and 5,411,852, and Maskasky et al 5,176,992 and 5,178,998. Ultrathin high chloride {111} tabular grain emulsions are illustrated by Maskasky 5,271,858 and 5,389,509.

High chloride {100} tabular grain emulsions are illustrated by Maskasky U.S. Pat. Nos. 5,264,337, 5,292,632, 5,275,930 and 5,399,477, House et al 5,320,938, Brust et al 5,314,798, Szajewski et al 5,356,764, Chang et al 5,413,904 and 5,663,041, Oyamada 5,593,821, Yamashita et al 5,641,620 and 5,652,088, Saitou et al 5,652,089, and Oyamada et al 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands arc less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Each of these types of photographic elements has its own particular requirements for dye hue, but in general they all prefer cyan dyes whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

Synthesis

The coupler of the invention is readily prepared through conventional techniques. See for example U.S. Pat. No. 5,925,503 for a suitable method.

Synthetic Example - Coupler M-2

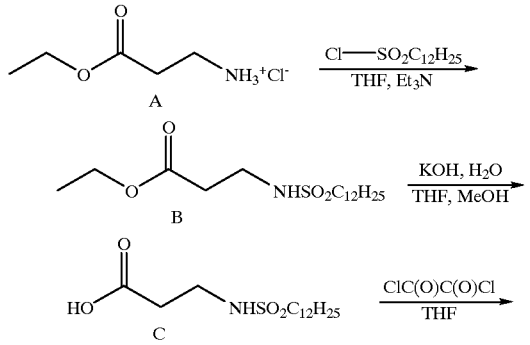

-continued

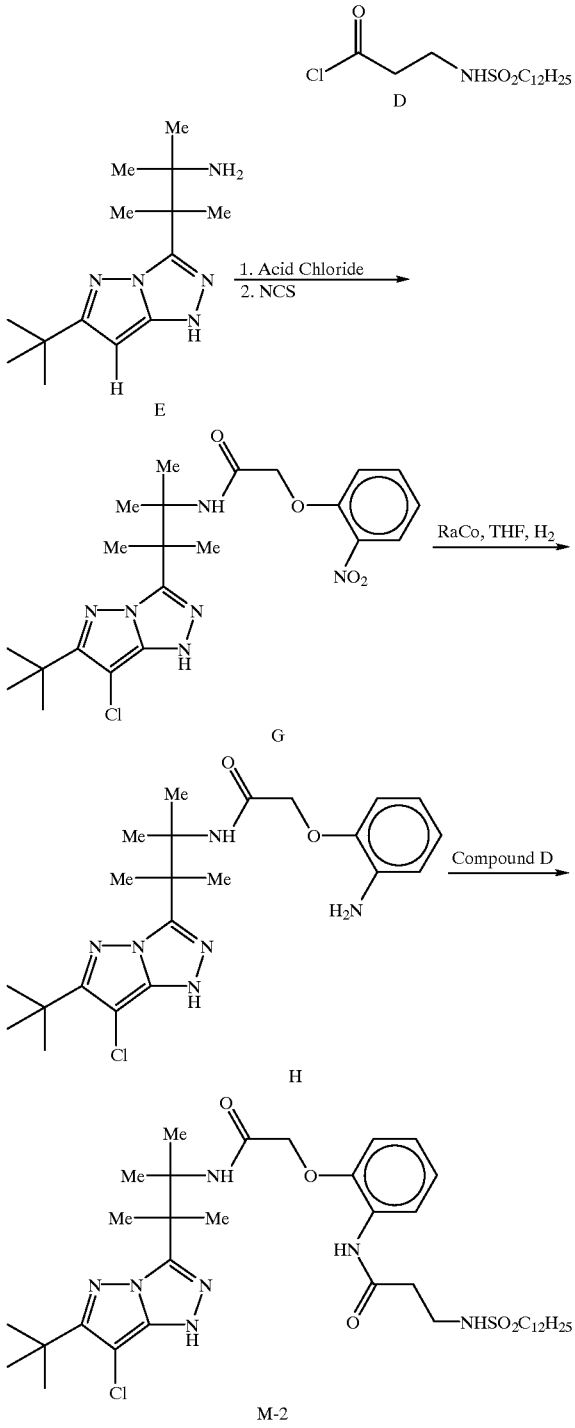

Synthesis of Compound B

To 300 mL of dry THF were added dodecanesulfonyl chloride (35.0 g, 0.130 mol) and β-alanine, ethyl ester, hydrochloride (20.0 g, 0.130 mol). Cool the stirred slurry in an ice bath and add triethyl amine ( 33.0 g, 0.325 mol) dropwise over 20 minutes. Remove the ice bath and stir for one hour. Partition the resulting thick slurry between 250 mL ethyl acetate and 500 mL water containing 25 mL concentrated HCl. Wash the organic phase twice with 500 mL water, and then 100 mL brine. Dry the ethyl acetate solution over $MgSO_4$, filter, and evaporate to give a yellow oil which solidifies. Pass the material through a 6.4×10 cm pad of silica gel using methylene chloride as elutant. The resulting solution was evaporated to give a colorless oil that starts to crystallize. The oil was dissolved in 100 mL heptane and cooled in an ice bath for 30 min. The resulting product was filtered and washed with cold heptane to yield compound B (33g, 72.5%).

Synthesis of Compound C

Add compound B (32.0 g, 91.5 mmol) to 150 mL 1:1 THF:MeOH and warm the mixture to obtain a solution. Add a solution of KOH (18.1 g, 0.275 mol) in 40 mL water all at once. Add an addition 20 mL water to the resulting solution and let stand 30 min. Remove about half the volume of solvent and add 100 ml water. Acidify the solution with concentrated HCl. Add ice to cool the mixture to about 10° C. Cool the resulting slurry in an ice bath for 15 min and filter the product. Wash with water and then heptane to obtain compound C (29.4 g, 100%).

Synthesis of Compound D

Add compound C (2.77 g, 8.61 mmol) and three drops DMF to 25 mL THF to a 100 mL flask fitted with a reflux condenser with an gas outlet leading to a hood exhaust. Stir the mixture and add oxalyl chloride (1.20 g, 9.47) mmol all at once. After the gas evolution diminishes, wain the solution to near reflux for 15 min. Cool to room temperature and evaporate the solution to give compound D, a colorless solid. The solid was dissolved in 25 mL dry THF in a 100 mL flask, and immediately used to prepare M-2.

Synthesis of Compound F

Dissolve compound E (47.4 g, 0.180 mol) and triethyl amine (23.6 g, 0.23 mol) in a mixture of 150 mL dry acetonitrile and 50 mL THF. Place in a addition funnel 2-(2-nirtophenoxy)propionyl chloride (45.5, 0.198 mol) dissolved in 25 mL THF. Place the reaction flask in an ice bath and immediately begin adding the acid chloride dropwise to the stirred solution until all the Compound E has reacted, as shown by TLC (10% methanol in methylene chloride). Filter the resulting red-colored slurry and wash the triethylamine salts with THF. To the filtrate add 250 mL methanol and then, all at once, a solution of 50% aqueous NaOH and 50 ml water. After 15 min the solution was acidified with concentrated HCl to pH 5, and most the solvent removed on a rotary evaporator. The mixture was partitioned between 200 mL water and 300 mL ethyl acetate. The dark red organic layer was washed with 200 mL water and then 100 mL brine. It was dried over $MgSO_4$, treated with 10 g decolorizing charcoal, and filtered. The orange-red filtrate was evaporated, and the resulting glass chromatographed through 800 g silica gel in a 1 L sintered glass funnel using 2 L 10% ethyl acetate in methylene chloride and then 20% ethyl acetate. The product fractions, contaminated with 2-(2-phenoxy)propionic acid, were combined and evaporated. The residue was dissolved in 750 mL ether and extracted twice with 75 mL 2.5% $Na_2CO_3$. The organic phase was washed with 100 mL 1 N HCl and 100 mL brine. The solution was dried over $MgSO_4$, filtered, and evaporated to an orange glass. The product was crystallized from a solution in 75 mL isopropyl ether saturated with heptane to give Compound F (not shown) (57.4 g, 69.8%).

Synthesis of Compound G

Dissolve compound F (56.0 g, 0.123 mol) in 125 mL methylene chloride. Add N-chlorosuccinimide (18.1 g, 0.135 mol) in three portions to the stirred solution over 5 min. TLC (5% ethyl acetate in methylene chloride) shows unreacted compound F. Add additional Add N-chlorosuccinimide (1.6 g, 12 mmol) and stir 15 min. Add a solution of sodium hydrosulfite (5.0 g, 30 mmol) in 50 mL water and stir the mixture vigorously for 1 hr. Separate off the organic layer and evaporate off the THF. Dissolve the residue in a solution of 300 mL ethyl acetate and 50 mL heptane. Extract with 5×200 mL warm water. Extract with 50 mL brine, dry over $MgSO_4$, filter, and evaporate to obtain a solid. Triturate the solid with 200 mL of 3:1 isopropyl ether: heptane and filter to obtain Compound G (59.3 g, 98%).

Synthesis of Compound H

Compound G (40.7 g, 85.3 mmol) was dissolved in 500 mL THF, and the nitro group reduced with Raney Cobalt (15 g) at 500 lb hydrogen on a shaker for four hr. The solution was filtered and evaporated to a light green glass. The product was dissolved in 150 mL isopropyl ether, and the solution diluted with 200 mL heptane. The solution was stirred for 1.5 hr. The solid was filtered. The filtrate was evaporated, and the residue treated again to get a second crop. Obtained compound H (52.0 g, 95.6%).

Synthesis of M-2

A solution of compound H (3.0 g, 6.71 mmol) and N,N-dimethylaniline (1.2 g, 10.1 mmol) in 25 mL dry THF was treated with compound D (2.4 g, 7.05 mmol). After 15 min the reaction mixture was partitioned between 100 mL ethyl acetate and 100 mL water containing 5 mL concentrated HCl. The organic phase was washed with 100 mL water and then 50 mL brine. The organic phase was dried over $MgSO_4$, filtered, and evaporated to give coupler M-2 (5.05 g, 100%).

Photographic Examples

Dispersions of the couplers were prepared as described below. In one vessel, the coupler, coupler solvent, stabilizers, and ethyl acetate were combined and warmed to dissolve. To this solution was added gelatin, surfactant, and water. After manual mixing the mixture was passed three times through a Gaulin colloid mill.

EXAMPLE 1.

The photographic elements were prepared by coating the following layers in the order listed on a resin-coated paper support. Amounts are in g/m$^2$.

| | | |
|---|---|---|
| 1st layer | | |
| | Gelatin | 3.23 |
| 2nd layer | | |
| | Gelatin | 1.78 |
| | Coupler M-1 | 0.45 |
| | Solvent S-1 | 0.27 |
| | Solvent S-2 | 0.27 |
| | Stabilizer St-1 | 0.18 |
| | Stabilizer St-2 | 0.18 |
| | Stabilizer St-23 | 0.14 |
| | Green sensitized AgCl emulsion | 0.17 |
| 3rd layer | | |
| | Gelatin | 1.34 |
| | 2-(2H-benzotriazol-2-yl)-4,6-bis-(1,1-dimethyl-propyl)phenol | 0.73 |
| | UV-1 Tinuvin 326(Ciba-Geigy) | 0.13 |
| | Hexanoic acid, 2-ethyl-,1,4-cyclohexanediyl bis(methylene) ester | 0.29 |
| | 1,4-Benzenediol, 2,5-bis(1,1,3,3-tetamethylbutyl)- | 0.18 |
| 4th layer | | |
| | Gelatin | 1.40 |
| | Bis(vinylsulfonyhnethyl) ether | 0.14 |

-continued

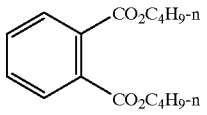

S-1

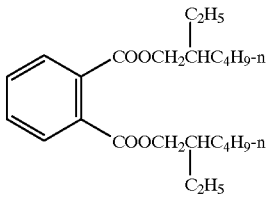

S-2

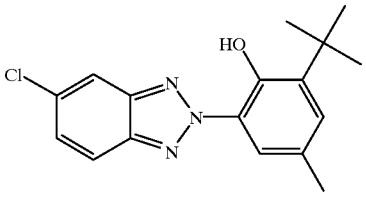

UV-1

Exposing and Processing of Photographic Elements

The photographic elements were given stepwise exposures to green light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| Developer | |
|---|---|
| Water | 700.00 mL |
| Triethanolamine | 12.41 g |
| Blankophor REU (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methane sulfonamidesesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.04 +/− 0.05 | |
| **Bleach-Fix** | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediamine tetraacetic acid (3.5%) | 110.40 g |
| Water to make | 1.00 L |
| pH @ 26.7° C. adjusted to 5.50 +/− 0.10 | |

Photographic Results

Magenta dyes were formed upon processing. The following photographic characteristics were determined: $D_{max}$ (the maximum density to green light.); Speed (the relative log exposure required to yield a density to green light of 1.0); and contrast (the ratio (S-T)/0.06, where S is the density at a log exposure 0.3 greater than the Speed value and T is the density at a log exposure 0.3 units less than the Speed value).

The combination of this invention provides comparable and acceptable values for $D_{max}$, Contrast, Speed, and other photographic properties when they are coated, exposed in a controlled manner, and processed as above.

The combination of this invention also improves the light stability of the magenta dye that is formed using the conventional RA-4 process. Tables 1 and 2 contain data on the relative stability of couplers of the invention in comparison to Comparison Couplers based on Status A density losses that are observed from process strips when they are exposed to 50 klux light for 28 days.

Comp 1

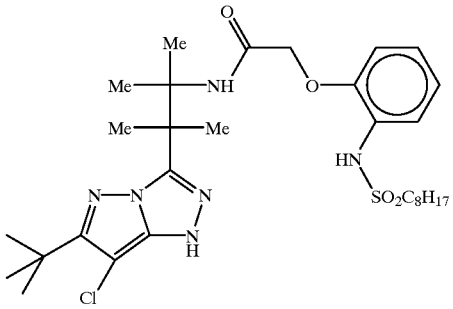

Comp 2

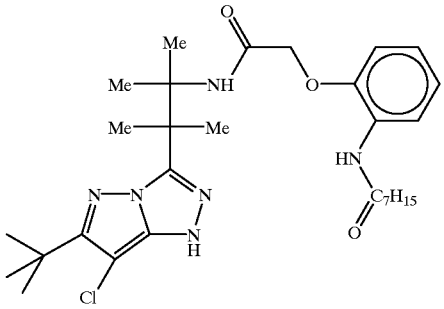

Comp 3

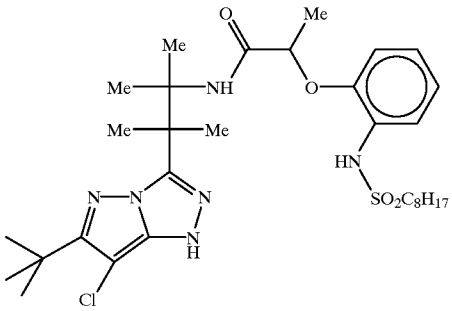

-continued

Comp 4

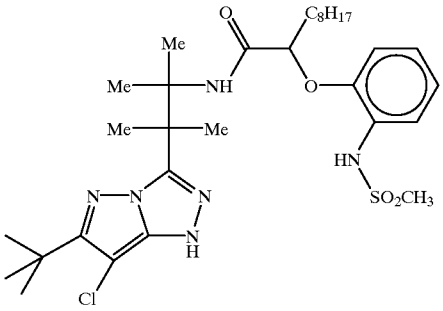

Comp 5

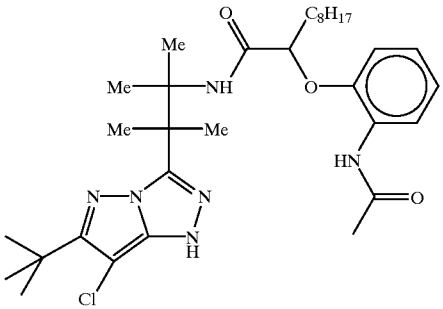

TABLE 1

Couplers where $R^a$ and $R^b$ are H

| Coupler | n | $R^c$, $R^d$ on α-Carbon | $R^e$ | Z | Stability of Couplers Relative to Comp 1 (From Density 1.0, 4 Wk) |
|---|---|---|---|---|---|
| M-3 | 1 | H, H | H | —C(O)$C_{11}H_{23}$ | 1.32 |
| M-4 | 1 | H, H | H | —S(O)$_2C_{12}H_{25}$ | 1.39 |
| M-22 | 1 | H, H | Me | —C(O)$C_9H_{19}$ | 1.18 |
| M-37 | 1 | H, Me | H | —$SO_2C_{12}H_{25}$ | 1.23 |
| M-27 | 1 | H, Bu-iso | H | —S(O)$_2C_8H_{17}$ | 1.18 |
| M-1 | 2 | H, H | H | —C(O)$C_9H_{19}$ | 1.16 |
| M-2 | 2 | H, H | H | —S(O)$_2C_{12}H_{25}$ | 1.55 |
| M-20 | 5 | H, H | H | —S(O)$_2C_8H_{17}$ | 1.16 |
| M-21 | 10 | H, H | H | —S(O)$_2C_8H_{17}$ | 1.20 |
| Inv Avg | | | | | 1.26 |
| Comp 1 | — | — | — | | 1.00 |
| Comp 2 | — | — | — | | 1.00 |

TABLE 2

Couplers where $R^a$, $R^b$ or both are Alkyl

| Coupler | n | $R^a$, $R^b$ | $R^c$, $R^d$ on α-Carbon | $R^e$ | Z | Stability of Couplers Relative to Comp 1 (From Density 1.0, 4 Wk) |
|---|---|---|---|---|---|---|
| M-6 | 1 | H, Me | H, H | H | —S(O)$_2C_{12}H_{25}$ | 1.40 |
| M-39 | 1 | H, Et | H, H | H | —S(O)$_2C_8H_{17}$ | 1.41 |
| M-35 | 1 | H, Et | H, H | H | —S(O)$_2C_{12}H_{25}$ | 1.46 |
| M-41 | 1 | H, Bu | H, H | H | —$COC_7H_{15}$ | 1.30 |
| M-38 | 1 | H, Bu | H, H | H | —S(O)$_2C_8H_{17}$ | 1.52 |
| M-26 | 1 | H, Bu | H, H | H | —P(O)(OBu)$_2$ | 1.53 |
| M-31 | 1 | H, —$C_8H_{17}$ | H, H | H | —S(O)$_2CH_3$ | 1.56 |
| M-30 | 1 | H, —$C_8H_{17}$ | H, H | H | —C(O)$CH_3$ | 1.45 |
| M-34 | 1 | Me, Me | H, H | H | —S(O)$_2C_8H_{17}$ | 1.39 |
| M-5 | 2 | H, Me | H, H | H | —$COC_9H_{19}$ | 1.21 |
| M-36 | 2 | H, Me | H, H | H | —S(O)$_2C_{12}H_{25}$ | 1.36 |
| M-40 | 2 | H, Et | H, H | H | —P(O)(OBu)$_2$ | 1.34 |
| M-25 | 2 | H, Et | H, H | H | —P(O)(OBu)$_2$ | 1.34 |
| M-28 | 2 | H, Bu | H, H | H | —S(O)$_2C_6H_4$Me-p | 1.32 |
| M-29 | 2 | H, Bu | H, H | H | —SO2$C_8H_{17}$ | 1.47 |
| M-42 | 2 | H, —$C_8H_{17}$ | H, H | H | —COEt | 1.32 |
| Inv Avg | | | | | | 1.40 |
| Comp 3 | | H, Me | | | | 1.17 |
| Comp 4 | | H, —$C_8H_{17}$ | | | | 1.24 |
| Comp 5 | | H, —$C_8H_{17}$ | | | | 1.24 |
| Comp Avg | | | | | | 1.22 |

An analysis of the data shows that the magenta dyes derived from the couplers of the invention are more stable to light exposure than the dyes formed by the comparison couplers. In Table 1, both $R^a$ and $R^b$ are H. In Table 2, $R^b$ is an alkyl substituent, and this appears to provide better stability in general. Comparison coupler Comp-3, -4, and -5 provide improved stability compared to Comp-1, but the inventive couplers are better yet. Table 1 shows an invention improvement of 26% over Comp-1. Table 2 shows an invention improvement of 40%, on average, over Comp-1 and an improvement, on average, of about 15% over Comp-3, -4, and -5.

The entire contents of the patents and other publications referred to in this specification are incorporated herein by reference.

What is claimed is:

1. A photographic element comprising a light-sensitive silver halide emulsion layer having associated therewith a bicyclic azole dye-forming coupler, having appended to a ring carbon at a non-coupling position thereof a substituent group represented by the formula:

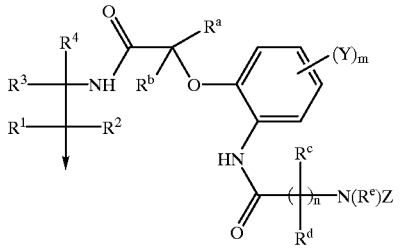

wherein the arrow represents the point of attachment of the substituent group to a non-coupling position of the coupler;

$R^1$, $R^2$, $R^3$ and $R^4$ are independently selected hydrogen or substituent groups, provided that any two of $R^1$, $R^2$, $R^3$ and $R^4$ may join to form a ring;

$R^a$ and $R^b$ are independently hydrogen or a substituent;

each $R^c$ and $R^d$ is an independently selected hydrogen or an alkyl or aryl group, provided that any two of them may join to form a ring and n is 1 to 10;

$R^e$ is hydrogen or an alkyl or aryl group;

each Y is an independently selected substituent group and m is from 0 to 4; and

Z is a substituent selected from the group consisting of $—C(O)R^5$, $—S(O)_2R^5$, $—SOR^5$, $—P(=O)(R^6)_2$ and $—P(=O)(OR^6)_2$ in which $R^5$ is selected from the group consisting of alkyl, aryl, heterocyclic, alkoxy, aryloxy, alkylamino, and arylamino groups and each $R^6$ is independently selected from the group consisting of alkyl and aryl groups; provided that Z can form a ring with any one of $R^c$ and $R^d$.

2. A photographic element comprising a light-sensitive silver halide emulsion layer having associated therewith a dye-forming coupler represented by the formula I:

I

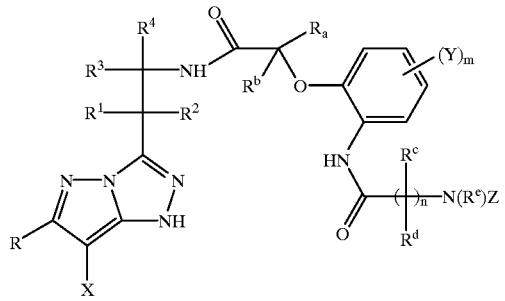

wherein

X is hydrogen or a coupling-off group;

R is a fully substituted carbon atom;

$R^1$, $R^2$, $R^3$ and $R^4$ are independently selected hydrogen or substituent groups, provided that any two of $R^1$, $R^2$, $R^3$ and $R^4$ may join to form a ring;

$R^a$ and $R^b$ are independently hydrogen or a substituent;

each $R^c$ and $R^d$ is an independently selected hydrogen or an alkyl or aryl group, provided that any two of them may join to form a ring and n is 1 to 10;

$R^e$ is hydrogen or an alkyl or aryl group;

each Y is an independently selected substituent group and m is from 0 to 4; and

Z is a substituent selected from the group consisting of $—C(O)R^5$, $—S(O)_2R^5$, $—SOR^5$, $—P(=O)(R^6)_2$ and $—P(=O)(OR^6)_2$ in which $R^5$ is selected from the group consisting of alkyl, aryl, heterocyclic, alkoxy, aryloxy, alkylamino, and arylamino groups and each $R^6$ is independently selected from the group consisting of alkyl and aryl groups; provided that Z can form a ring with any one of $R^c$ and $R^d$.

3. The element of claim 1 wherein at least one of $R^a$ and $R^b$ is hydrogen.

4. The element of claim 2 wherein at least one of $R^a$ and $R^b$ is a substituent.

5. The element of claim 4 wherein at least one of $R^a$ and $R^b$ is an alkyl group.

6. The element of claim 1 wherein n is 1–5.

7. The element of claim 2 wherein n is 1–5.

8. The element of claim 5 wherein n is 1–5.

9. The element of claim 1 wherein n is 1–2.

10. The element of claim 7 wherein n is 1–2.

11. The element of claim 8 wherein n is 1–2.

12. The element of claim 1 wherein Z is $—C(O)R^5$.

13. The element of claim 2 wherein Z is $—C(O)R^5$.

14. The element of claim 4 wherein Z is $—C(O)R^5$.

15. The element of claim 1 wherein Z is $—S(O)_2R^5$.

16. The element of claim 2 wherein Z is $—S(O)_2R^5$.

17. The element of claim 16 wherein $R^5$ is an alkyl group.

18. The element of claim 10 wherein Z is $—S(O)_2R^5$.

19. The element of claim 18 wherein $R^5$ is an alkyl group.

20. The element of claim 2 wherein Z is $—P(=O)(OR^6)_2$.

21. The element of claim 10 wherein Z is $—P(=O)(OR^6)$ 2·

22. The element of claim 11 wherein Z is $—P(=O)(OR^6)$ 2·

23. The element of claim 1 which is a direct-view element.

24. The element of claim 23 comprising a reflective support.

25. The element of claim 1 wherein the light-sensitive silver halide emulsion is sensitized to green light.

26. The element of claim 1 wherein the light-sensitive silver halide emulsion is sensitized to red light.

27. A process for forming a color image comprising contacting the element of claim 1 with a color developer after the element has been image-wise exposed to light.

* * * * *